US005425162A

United States Patent [19]

Buis et al.

[11] Patent Number: 5,425,162

[45] Date of Patent: Jun. 20, 1995

[54] METHOD AND APPARATUS TO CREATE AN IMPROVED MOIRE' FABRIC

[75] Inventors: Charles D. Buis, Greenville; Barry R. McClure, Campobello, both of S.C.

[73] Assignee: Milliken Research Corporation, Spartanburg, S.C.

[21] Appl. No.: 156,289

[22] Filed: Nov. 22, 1993

[51] Int. Cl.[6] ..... D06C 23/04

[52] U.S. Cl. ..... 26/69 R; 28/163

[58] Field of Search ..... 26/1, 18.6, 99, 69 R, 26/69 A; 28/163, 165

[56] References Cited

U.S. PATENT DOCUMENTS

| | | | |
|---|---|---|---|
| 304,417 | 9/1884 | Fletcher | 26/69 R |
| 634,307 | 10/1899 | Neidhardt | 26/99 |
| 679,425 | 7/1901 | Kertesz | 26/99 |
| 1,635,091 | 7/1927 | Lyth | 26/69 R |
| 2,024,177 | 12/1935 | Mellor et al. | 101/32 |
| 2,144,685 | 1/1939 | Mellor et al. | 26/69 R |
| 2,180,745 | 11/1939 | Milhomme | 26/69 R |
| 2,448,145 | 8/1948 | Holterhoff | 26/69 R |
| 2,513,646 | 7/1950 | Holterhoff | 26/69 R |
| 2,598,795 | 6/1952 | Holterhoff | 26/69 R |
| 2,825,117 | 3/1958 | Evans et al. | 26/69 A |
| 3,247,785 | 4/1966 | Shultz | 26/69 R |
| 3,507,943 | 4/1970 | Such et al. | 28/163 |

FOREIGN PATENT DOCUMENTS

| | | | |
|---|---|---|---|
| 59-39548 | 9/1984 | Japan | 26/69 R |
| 268824 | 6/1950 | Switzerland | 26/69 R |
| 3019 | 12/1853 | United Kingdom . | |
| 21590 | 8/1907 | United Kingdom | 26/69 R |
| 21591 | 9/1907 | United Kingdom | 26/69 R |
| 352410 | 7/1931 | United Kingdom | 26/69 R |
| 2116593 | 9/1983 | United Kingdom | 28/163 |

OTHER PUBLICATIONS

"New Developments in Moire Finishing", *Canadian Textile Journal*, Holterhoff, Hans; May 5, 1949 (Cl 26/69R), pp. 48–64.

*Primary Examiner*—Clifford D. Crowder
*Assistant Examiner*—Amy B. Vanatta
*Attorney, Agent, or Firm*—Kevin M. Kercher; Terry T. Moyer

[57] ABSTRACT

An apparatus and method for creation of moiré fabric by moving textile fabric over a member, with a longitudinal axis, having several areas of a lesser width or diameter along the longitudinal axis and several areas of a greater width or diameter along the longitudinal axis and sloped portions therebetween interconnecting the areas of greater width or diameter with the areas of lesser width or diameter. The areas of greater width or diameter on the member form lobes that retard the movement of filling yarns of the textile fabric by creating a longer path for the textile fabric to traverse thereby shifting the filling yarns while the areas of lesser width or diameter on the member form valleys that advance the movement of filling yarns of the textile fabric by creating a shorter path for the textile fabric to traverse. This shifting provides the proper filling pattern for the conventional moiré fabric.

23 Claims, 3 Drawing Sheets

METHOD AND APPARATUS TO CREATE AN IMPROVED MOIRE' FABRIC

BACKGROUND OF THE INVENTION

This invention relates to a method and apparatus for creation of moiré fabric. Traditional moiré fabrics are defined as a wavy or watered effect on textile fabric, especially a corded fabric of silk, rayon, or one of the manufactured fibers. An excellent example of a corded fabric would be a faille. Failles are generally defined as having fine, bright, continuous filament warp yarns, coarse spun filling yarns, and a plain weave. This creates a noticeable ribbed effect in the filling direction. Other fabrics can be utilized with typically lesser results, however, a visible ribbed effect should be present in the fabric's filling.

Moiré fabric falls into one of two categories. The first is an uncontrolled moiré where the filling ribs of one layer of fabric are intentionally skewed with respect to the second layer of fabric prior to applying pressure to both layers of fabric. This will result in a significant increase in the number of filling ribs that cross with the associated increase in vertical moiré lines. This is very undesirable since the appearance of the moiré fabric will never be consistent and will vary from batch to batch. Traditionally, controlled moiré fabric is formed by selectively distorting or skewing small portions of the filling ribs so that the filling ribs only cross in selective areas. The most common method is the Francais bar method in which ribbed woven fabric is dragged over a stationary bar, which has a series of knobs which are spaced at desired intervals. This is performed at very high tension. The knobs distort the filling into a bow wherever they touch the fabric. When two pieces of this fabric are subjected to pressure, a traditional controlled moiré will result that is typically found in upholstery, drapery, apparel, and other end uses. Problems with this type of moiré patterning include the fact that the pattern is repeatedly fixed and dragging under high tension can damage and/or destroy the fabric.

Another traditional method utilized in creating controlled moiré fabric is the "scratch" method. This is accomplished by means of a resilient roll having the desired designs embossed thereon. These designs may include flowers, geometries, and so forth. While the fabric is in contact with this embossed roll, it is "scratched" with a series of steel blades which distort the filling yarns of the fabric according to the pattern embossed on the roll. Upon applying pressure to two pieces of this treated fabric, a moiré pattern is produced. Again, there is the problem of the destruction or damage to yarns by the steel blades and a fixedly repeatable pattern. This "scratch" method produces very poor results with a large quantity of broken filaments. The blades actually only contact the warp yarns thus producing a large amount of broken filaments with only minimal movement of the filling yarn. It is the movement of the filling yarn that is the desired result. Furthermore, by examination of faille fabric, the filling is virtually covered by warp yarns and thus it is very difficult to move the filling yarns by mechanical means. Also, this "scratch" method creates fuss on the surface of the fabric that results in less shine and poor moiré patterns.

Yet another traditional method of producing a controlled moiré is by that found in U.S. Pat. No. 2,448,145, which discloses the selective application of water to fabric with a noticeable ribbed effect in the filling direction. The fabric is then placed under high tension and then dried. This will distort the filling yarns in the wet areas differently than the filling yarns in the dry areas. Again, upon applying pressure to two pieces of this treated fabric, a moiré pattern is produced. A severe problem with this technology is that it would be very difficult to selectively wet yarns while leaving adjacent yarns dry for a very precise pattern. Furthermore, stretching under high tension can severely weaken or even destroy filling yarns. Furthermore, this method is deficient in that it only works on fibers that absorb large amounts of water such as cotton, silk, and so forth. Each pattern requires a specific patterning roll or screen which only changes the pick count slightly in the areas treated with water. While this may produce some beating when the fabrics are sandwiched and calendered, this does not produce a true moiré pattern because the filling is not distorted with bow or skew.

The present invention solves these problems in a manner not disclosed in the known prior art.

SUMMARY OF THE INVENTION

An apparatus and method for creation of moiré fabric by moving textile fabric over a member, with a longitudinal axis, having several areas of a lesser width or diameter along the longitudinal axis and several areas of a greater width or diameter along the longitudinal axis and sloped portions therebetween interconnecting the areas of greater width or diameter with the areas of lesser width or diameter. The areas of greater width or diameter on the member form lobes that retard the movement of filling yarns of the textile fabric by creating a longer path for the textile fabric to traverse thereby shifting the filling yarns while the areas of lesser width or diameter on the member form valleys that advance the movement of filling yarns of the textile fabric by creating a shorter path for the textile fabric to traverse. This shifting provides the proper filling pattern for the conventional moiré fabric. It is an advantage of this invention that the advancing and retarding of filling yarns can be produced without damage to the warp yarns.

Yet another advantage of this invention is that the textile fabric is not exposed to friction or abrasion.

Still another advantage of this invention is that this invention can be utilized in an in-line process that can be performed in a single step.

Another advantage of this invention is that the design of the member substantially determines the amount of filling shift rather then fabric tension or some friction coefficient of either the fabric or a scratching device.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which.

Corresponding reference characters indicate corresponding parts throughout the several views of the drawings.

DETAILED DESCRIPTION OF THE PREFERRED EMBODIMENT

Figure 2:
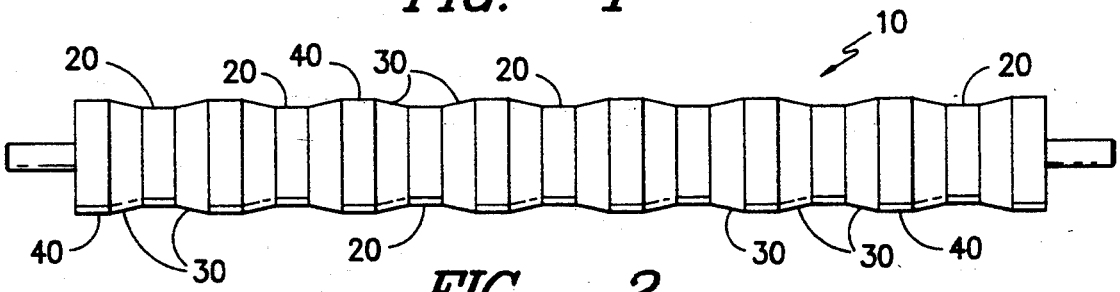
FIG. 2 is an isolated elevational side view of the cylindrical roll of the present invention as shown in FIG. 1, having a series of lobes for retarding filing yarn and a series of valleys for advancing filing yarn.

Referring now to the accompanying drawings, and initially to FIG. 2, which discloses an apparatus for generating moiré fabric utilizing a member of the present invention, generally indicated by numeral 10. In this embodiment, the member is cylindrical having several areas of a lesser diameter 20 and several areas of a greater diameter 40 and sloped portions 30 therebetween interconnecting the areas of lesser diameter 20 with the areas of greater diameter 40. The areas of greater diameter 40 on the cylindrical member 10 form lobes that retard the movement of filling yarns over the cylindrical member 10 thereby shifting the filling yarns by creating a longer path for the textile fabric 10 to traverse while the areas of lesser diameter 20 on the cylindrical member 10 form valleys that advance the movement of filling yarns by creating a shorter path for the textile fabric 10 to traverse. This shifting provides the proper filling pattern for the conventional moiré fabric. These three areas 20, 30, and 40 can either rotate around the cylindrical member 10 or become a fixed part of the cylindrical member 10.

For conventional moiré fabric, there are a number of parameters that define this cylindrical member 10. The areas of lesser diameter 20 and the areas of greater diameter 40 have a width along the longitudinal axis of the cylindrical member of at least one thirty-second of an inch to the entire width of the fabric, which is typically seventy-two inches, The tapered, sloped portions 30 should also range in width along the longitudinal axis of the cylindrical member from one thirty-second of an inch to the width of the textile fabric. The diameter of the areas of greater diameter 40 forming lobes can preferably range from one thirty-second of an inch to over thirty-six inches while the diameter of the areas of lesser diameter 20 forming valleys can also range from one thirty-second of an inch to over thirty-six inches. The diameter of the areas of greater diameter 40 forming lobes must exceed the diameter of the areas of lesser diameter 20 forming valleys by at least one thirty-second of an inch.

Figure 1:
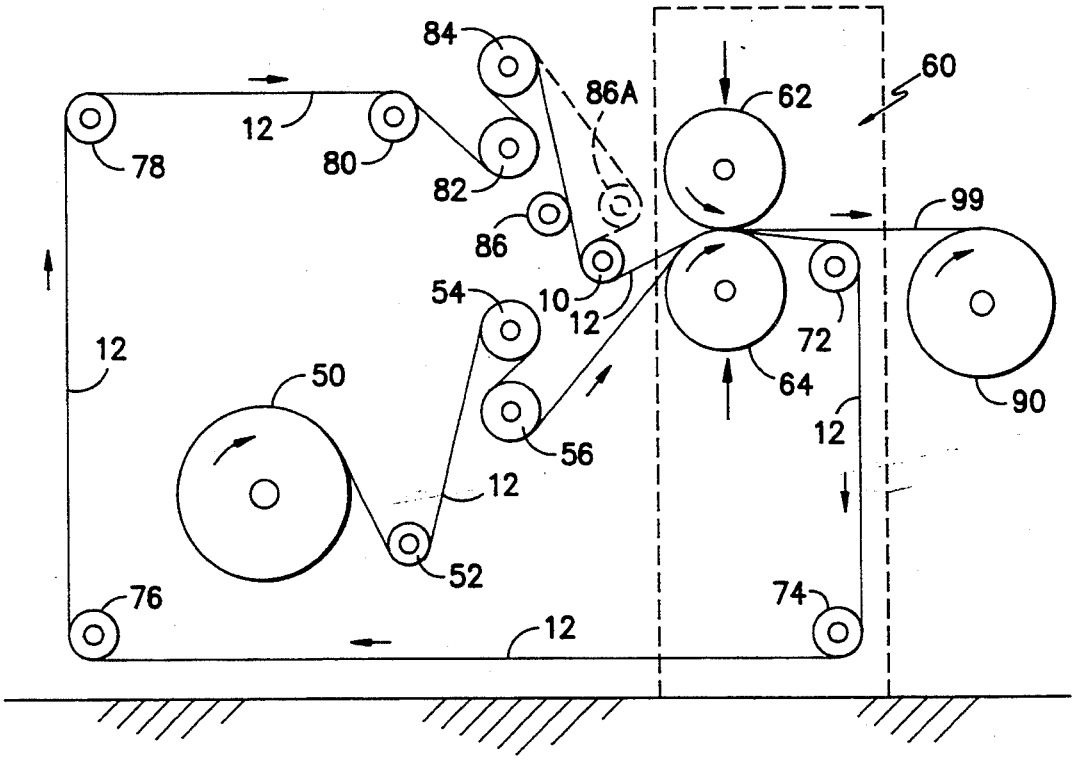
FIG. 1 is a schematicized side view of an apparatus for generating moiré fabric utilizing a cylindrical roll of the present invention having a series of lobes for retarding filing yarn and a series of valleys for advancing filing yarn in conjunction with a chase calendering system.

Referring now to FIG. 1, which discloses the cylindrical member 10 utilized in conjunction with a chase calendering system to process textile fabric to form a moiré pattern thereon. The textile fabric is generally indicated by numeral 12. The first step in this process is for unpatterned fabric 12 to be removed from supply roll 50 and then passed over three idler rolls indicated by numerals 52, 54 and 56, respectively. The unpatterned textile fabric 10 is then processed by a calender mechanism that is generally indicated by numeral 60 having an upper calendering roll 62 and lower calendering roll 64. This unpatterned textile fabric 12 passes against the upper surface of the lower calendering roll 64 and against this same textile fabric 12A that has been processed by cylindrical member 10. Processing, as previously described, involves the patterned shifting of filling yarns with the lobes formed from the areas of greater diameter 40 on the cylindrical member 10 retarding the movement of the filling yarns over the cylindrical member 10 thereby shifting the filling yarns by creating a longer path for the textile fabric 10 to traverse and the valleys formed from the areas of lesser diameter 20 on the cylindrical member 10, thereby advancing the movement of the filling yarns by creating a shorter path for the textile fabric 10 to traverse. The processed textile fabric 12A is held against the unprocessed textile fabric 12 by means of the lower surface of the upper calendering roll 62. With this embodiment, the preferred material for the upper calendering roll 62 is a metal such as steel and the preferred material for the lower calendering roll 64 is a lightweight polymer.

Figure 3:
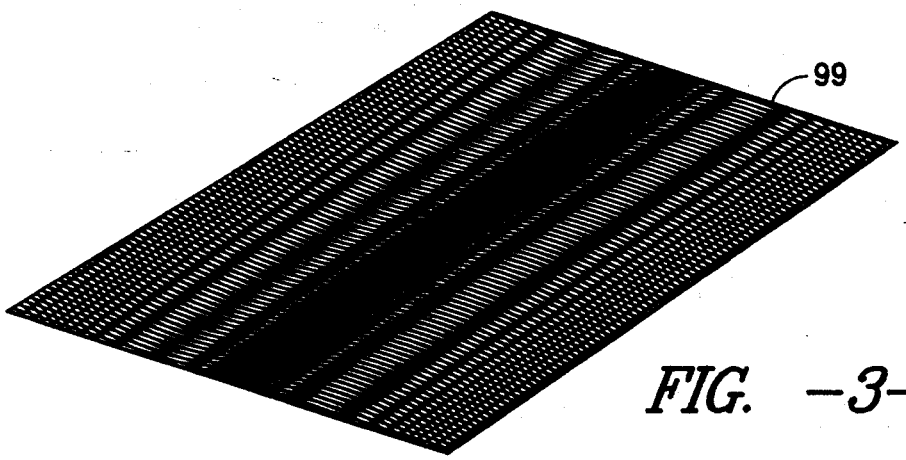
FIG. 3 is a perspective view of a piece of textile fabric having a moiré pattern in which the filling yarns have been laterally shifted by the present invention and then subjected to pressure by means of calendering.

The unprocessed textile fabric 12 then leaves the calender mechanism 60 and then passes over idler roll 72 which directs the unprocessed textile fabric 12 in a downwardly vertical direction, then over idler roll 74 which directs the unprocessed textile fabric 12 in a horizontal direction, then over idler roll 76 which directs the unprocessed textile fabric 12 in an upwardly vertical direction, then over idler roll 78 which directs the unprocessed textile fabric 12 in a horizontal direction, which is maintained in a horizontal condition by idler roll 80. The unprocessed textile fabric 12 then loops over idler roll 82 and idler roll 84 to provide tension and then passes over idler roll 86 that controls the angle of wrap around cylindrical roll 10. Idler roll 86A demonstrates an alternative location for idler roll 86 to provide a greater degree of wrap. The preferred range for wrap around the cylindrical roll is between forty-five degrees to two hundred and seventy degrees with optimal results at 180 degrees. The textile fabric 12 is then processed by the cylindrical roll 10, as previously described, thereby forming the processed textile fabric 12A. The processed textile fabric 12A then passes into calender mechanism 60 between the upper calendering roll 62 and the unprocessed textile fabric 12 as was also previously described. This moiré patterned textile fabric is now designated by numeral 99 and is collected in a continuous manner on a take-up roll 90. Flattened areas in the ribs reflect more light and create a contrast to unflattened areas. The crushed and uncrushed portions of textile fabric 99 causes a difference in light reflectance. This creates a wavy or watery effect in textile fabric 99, as shown in FIG. 3.

Figure 7:
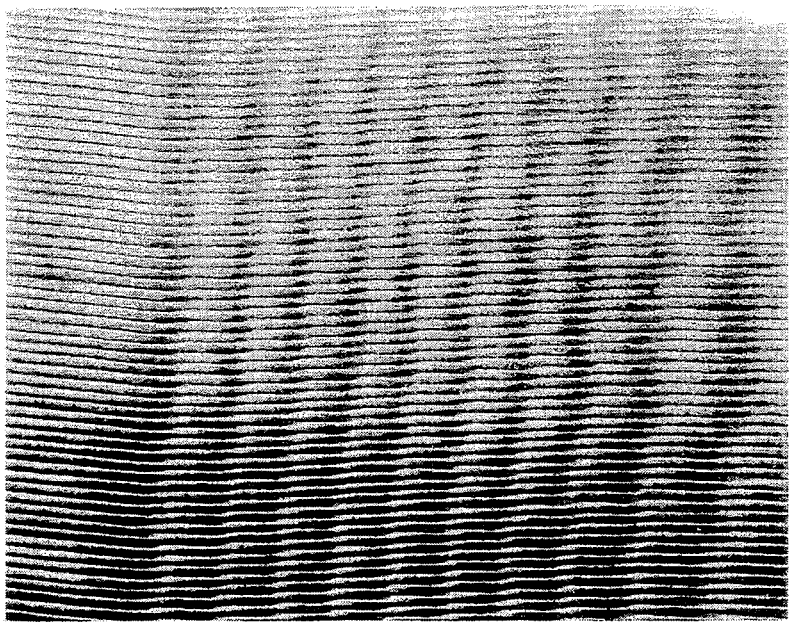
FIG. 7 is a photomicrograph (1.9×) of the face of the fabric of Example 1 after the step of selectively retarding and advancing fill yarns of the fabric and the step of calendering under one ton of pressure per linear inch with a second layer of the untreated fabric of FIG. 6.

The moiré patterns are produced when the upper processed textile fabric 12A is sandwiched with same lower unprocessed textile fabric 12 and passed through the calender rolls 62 and 64 at high pressure so that wherever the filling yarns cross, a moiré pattern is produced. For good patterning, both the unprocessed and processed textile fabric 12 and 12A should be ribbed since the surface of the upper calendering roll 62 is smooth as well as the surface of lower calendering roll 64. The unpatterned textile fabric 12 may be the higher fabric with the patterned textile fabric 12A being the lower textile fabric with no consequential difference. A pressure of 300 to 10,000 pounds per linear inch of fabric between the upper calendering roll 62 and lower calendering roll 64 on the textile fabric 12 causes a ribbed pattern to be created. The moiré pattern appears on both sides of the textile fabric. However, the moiré pattern produced during the first pass through calender rolls 62 and 64 is placed on the back of the textile fabric 12. This moiré pattern is removed and replaced after the shifting of the filling yarns with the cylindrical roll member 10 by means of the heat and pressure of the second pass through calender rolls 62 and 64, as shown by the photomicrograph of FIG. 7 at 1.9 magnification. The lower calender roll 64 is air cooled so the temperature does not typically exceed 120 degrees Fahrenheit. Pressure requirements for producing moiré depend on the speed of traverse, temperature, moisture, and types of calender rolls utilized. A typical range for temperature would be between 100 and 450 degrees Fahrenheit. A typical range for moisture would be between 30 and 100 percent relative humidity for natural fibers. Artificial fibers are typically unaffected by relative humidity. The speed of traverse is typically between 5 and 100 feet per minute and preferably 12 to 24 feet per minute. The speed of rotation of the calender rolls 62 and 64, respectively, typically ranges between 2.5 to 50 revolutions per minute with the preferred range being between 6 to 12 revolutions per minute.

With this preferred embodiment, the preferred material for the upper calendering roll 62 is a metal such as steel and the preferred material for the lower calendering roll 64 is a lightweight polymer, such as nylon. A typical calendar of this type is manufactured by Ramisch Kleinewefers Kalander GmbH in 1975 located at 415 Krefeld, Postfach 2350, Germany. Other methods of applying pressure include high pressure rotary presses and platen presses. Some very beautiful textile fabrics are produced by creating the moiré fabric and then printing the textile fabric with a colorant such as a dye or pigment. The fabric may, also, be printed first and then processed with shifting of the filling yarns and then calendered under pressure to produce a different effect. It may also be processed with shifting of the filling yarns, printed and then calendered to produce a novel textile fabric. Any type of textile fabric printing may be used including but not limited to rotary screen, flat bed, air brush or engraved roll.

Most fiber types will work with this invention including, but not limited to, polyester, polyamide, acetate, rayon, cotton, and so forth. This invention is not restricted to plain weaves but most woven fabrics will work including, but not limited to, dobby and jacquard woven fabrics. Woven fabrics have warp yarns extending in the warp direction and fill yarns extending in the fill direction. For best results, the fill yarns should have a ribbed effect. Furthermore, this invention is not restricted to woven fabrics since a moiré pattern can be applied to warp knit fabrics. Warp knit fabrics have wales which are a column of loops lying lengthwise in the fabric and correspond to the warp in woven fabrics. Also, warp knit fabrics have courses which are a row of loops or stitches running across a knit fabric corresponding to filing in woven fabrics.

Beat repeat patterns may be introduced by having the pick count different in the two layers of textile fabric 12 and 12A that are sandwiched together. This may be accomplished by placing tension on either the processed layer of textile fabric 12A or the unprocessed layer of textile fabric 12 which will reduce the pick count slightly to produce a beating. "Beating" is defined as the pattern developed due to superimposed waves of different frequencies.

Figure 4:
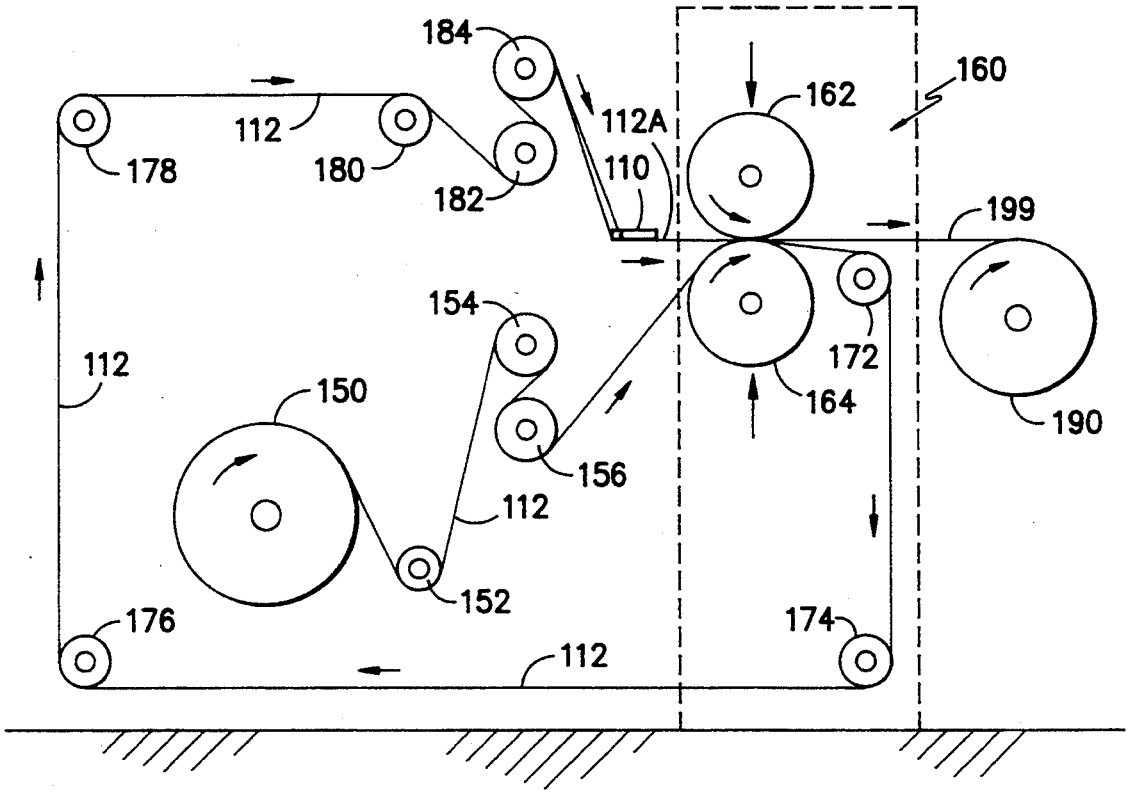
FIG. 4 is a schematicized side view of an apparatus for generating moiré fabric utilizing a rectangular member of the present invention having a series of lobes for retarding filing yarn and a series of valleys for advancing filing yarn in conjunction with a chase calendering system.
Figure 5:
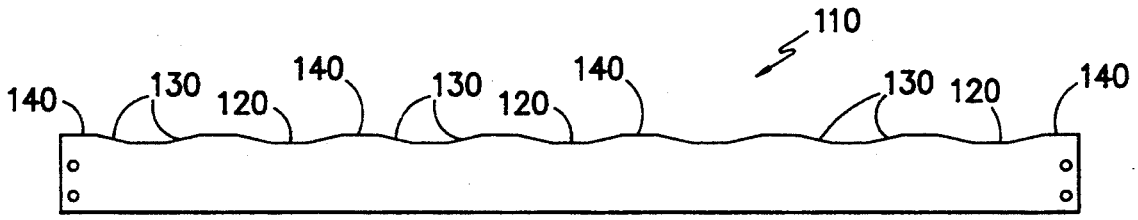
FIG. 5 is an isolated elevational side view of the rectangular member of the present invention as shown in FIG. 4, having a series of lobes for retarding filing yarn and a series of valleys for advancing filing yarn.

An alternative embodiment utilizes a rectangular member that is generally indicated by numeral 110 having substantially the same nodes and valleys as the cylindrical member 10. This embodiment is preferred merely due to the decreased construction cost of the rectangular member 110 versus a cylindrical member 10. Referring now to FIGS. 4 and 5, having corresponding numerals in the one hundred series that can be correlated to the numerals in FIGS. 1, 2, and 3. Rectangular member 110, has several areas that of a lesser width 120 and several areas of a greater width 140 and sloped portions 130 therebetween interconnecting the areas of lesser width 120 with the areas of greater width 140. The areas of greater width 140 on the rectangular member 110 form lobes that retard the movement of filling yarns over the rectangular member 110 by creating a longer path for the textile fabric 112 to traverse thereby shifting the filling yarns while the areas of lesser width 120 on the rectangular member 110 form valleys that advance the movement of filling yarns by creating a shorter path for the textile fabric 112 to traverse on the rectangular member 110. This shifting provides the proper filling pattern for the conventional moiré fabric.

For conventional moiré fabric, there are a number of parameters that define this rectangular member 110. The areas of lesser width 120 and the areas of greater width 140 have a length along the longitudinal axis of the rectangular member of at least one thirty-second of an inch to the entire width of the fabric, which is typically seventy-two inches. The tapered, sloped portions 130 should also range in length along the longitudinal axis of the rectangular member from one thirty-second of an inch to the width of the textile fabric. The areas of greater width 140 forming lobes can preferably range from one thirty-second of an inch to over thirty-six inches while the areas of lesser width 120 forming valleys can also range from one thirty-second of an inch to over thirty-six inches. The areas of greater width 140 forming lobes must exceed the areas of lesser width 120 forming valleys by one thirty-second of an inch.

Referring now to FIG. 4, which discloses the rectangular member 110 utilized in conjunction with a chase calendering system to process textile fabric to form a moiré pattern thereon. The rectangular member 110 may be merely a typical two by eight piece of lumber. The textile fabric is generally indicated by numeral 112. The first step in this process is for unpatterned fabric 112 to be removed from supply roll 150 and then passed over three idler rolls indicated by numerals 152, 154 and 156, respectively. The unpatterned textile fabric 112 is then processed by a calender mechanism that is generally indicated by numeral 160 having an upper calendering roll 162 and lower calendering roll 164. This unpatterned textile fabric 112 passes against the upper surface of the lower calendering roll 164 and against this same textile fabric 112A that has been processed by rectangular member 110. Processing, as previously described, involves the patterned shifting of filling yarns with the lobes formed from the areas of greater width 140 on the rectangular member 110 retarding the movement of the filling yarns over the rectangular member 110 by creating a longer path for the textile fabric 112 to traverse thereby shifting the filling yarns and the valleys formed from the areas of lesser width 120 on the rectangular member 110, thereby advancing the movement of the filling yarns by creating a shorter path for the textile fabric 112 to traverse. The processed textile fabric 112A is held against the unprocessed textile fabric 112 by means of the lower surface of the upper calendering roll 162. With this embodiment, the preferred material for the upper calendering roll 162 is a metal such as steel and the preferred material for the lower calendering roll 164 is a lightweight polymer.

The unprocessed textile fabric 112 then leaves the calender mechanism 160 and then passes over idler roll 172 which directs the unprocessed textile fabric 112 in a downwardly vertical direction, then over idler roll 174 which directs the unprocessed textile fabric 112 in a horizontal direction, then over idler roll 176 which directs the unprocessed textile fabric 112 in an upwardly vertical direction, then over idler roll 178 which directs the unprocessed textile fabric 112 in a horizontal direction, which is maintained in a horizontal condition by idler roll 180. The unprocessed textile fabric 112 then loops over idler roll 182 and idler roll 184 that controls the angle of wrap around rectangular member 110. The preferred range for wrap around the rectangular member 110 is between forty-five degrees to two hundred and seventy degrees with the optimal results found at ninety degrees. The textile fabric 112 is then processed by the rectangular member 110, as previously described, and then forms the processed textile fabric 112A. The processed textile fabric 112A then passes into calender mechanism 160 between the upper calendering roll 162 and the unprocessed textile fabric 112, as was also previously described. This moiré patterned textile fabric is now designated by numeral 199 and is collected in a continuous manner on a take-up roll 190. Flattened areas in the ribs reflect more light and create a contrast to unflattened areas. The crushed and uncrushed portions of textile fabric 199 causes a difference in light reflectance. This creates a wavy or watery effect in textile fabric 199 that is identical to that shown for textile fabric 99 in FIG. 3.

The moiré patterns are produced when the upper processed textile fabric 112A is sandwiched with same lower unprocessed textile fabric 112 and passed through the calender rolls 162 and 164 at high pressure so that wherever the filling yarns cross, a moiré pattern is produced. For good patterning, both the unprocessed and processed textile fabric 112 and 112A should be ribbed since the surface of the upper calendering roll 162 is smooth as well as the surface of lower calendering roll 164. The unpatterned textile fabric 112 may be the higher fabric with the patterned textile fabric 112A being the lower textile fabric with no consequential difference. A pressure of 300 to 10,000 pounds per linear inch of fabric between the upper calendering roll 162 and lower calendering roll 164 on the textile fabric 112 causes a ribbed pattern to be created. The moiré pattern appears on both sides of the textile fabric. However, the moiré pattern produced during the first pass through calender rolls 162 and 164 is placed on the back of the textile fabric 112. This moiré pattern is removed and replaced after the shifting of the filling yarns with the rectangular member 110 by means of the heat and pressure of the second pass through calender rolls 162 and 164, as shown by the photomicrograph of FIG. 7 at 1.9 magnification. The lower calender roll 164 is air cooled so the temperature does not typically exceed 120 degrees Fahrenheit. Pressure requirements for producing moiré depend on the speed of traverse, temperature, moisture, and types of calender rolls utilized. A typical range for temperature would be between 100 and 450 degrees Fahrenheit. A typical range for moisture would be between 30 and 100 percent relative humidity for natural fibers. Artificial fibers are typically unaffected by relative humidity. The speed of traverse is typically between 5 and 100 feet per minute and preferably 12 to 24 feet per minute. The speed of rotation of the calender rolls 162 and 164, respectively, typically ranges between 2.5 to 50 revolutions per minute with the preferred range being between 6 to 12 revolutions per minute.

With this preferred embodiment, the preferred material for the upper calendering roll 162 is a metal such as steel and the preferred material for the lower calendering roll 164 is a lightweight polymer, such as nylon. A typical calendar of this type is manufactured by Ramisch Kleinewefers Kalander GmbH in 1975 located at 415 Krefeld, Postfach 2350, Germany. Other methods of applying pressure include high pressure rotary presses and platen presses. Some very beautiful textile fabrics are produced by creating the moiré fabric and then printing the textile fabric with a colorant such as a dye or pigment. The fabric may, also, be printed first and then processed with the shifting of the filling yarns and then calendered under pressure to produce a different effect. It may also be processed with shifting of the filling yarns, printed and then calendered to produce a novel textile fabric. Any type of textile fabric printing may be used including but not limited to rotary screen, flat bed, air brush or engraved roll.

The following examples demonstrate, without intending to be limiting in any way, the method by which fabrics of the present invention have been generated.

EXAMPLE 1

Figure 6:
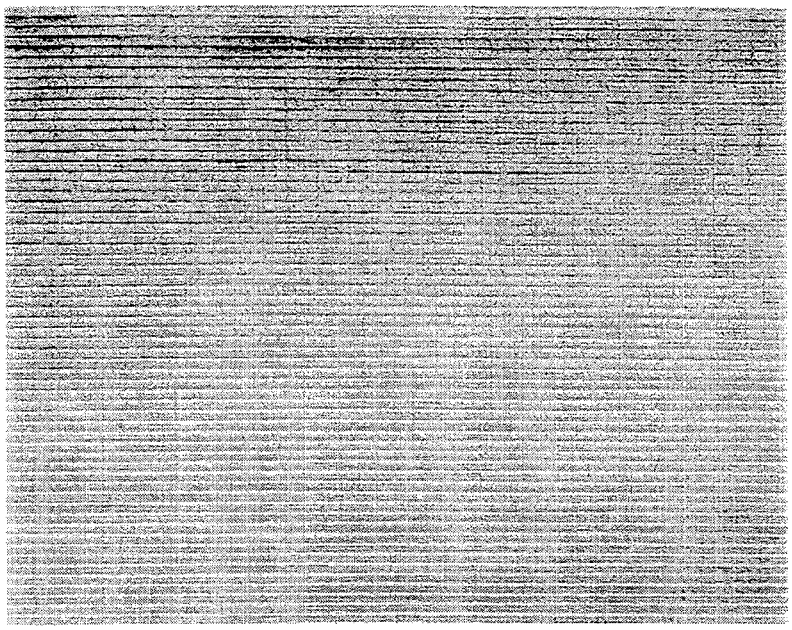
FIG. 6 is a photomicrograph (1.9×) of the face of the untreated faille fabric of Example 1.

An apparatus similar to that schematically depicted in FIG. 1 was used, in accordance with the following specifications:

Fabric: a faille fabric having a warp comprised of 220 ends/inch of 70 denier bright polyester continuous filament and a fill comprised of 8/1 spun polyester and a pick count of 32. The faille fabric has been woven, prepared, dyed and heat-set and has a weight of 5.8 ounces per square yard. A photomicrograph of this fabric is shown by FIG. 6 at 1.9 magnification. This textile fabric was then treated by passing over the cylindrical roll member 10, as shown in FIG. 1, having a plurality of lobes that retard the movement of the filling yarns of the textile fabric and a plurality of valleys that advance the movement of said filling yarns of the textile fabric. The textile fabric travels over the cylindrical roll member 10 at a rate of six yards per minute. This textile fabric with the shifted filling yarns was then sandwiched with a piece of the same fabric without shifted filling yarns and run through a Ramisch Kleinewefers Kalander GmbH® calender at six yards a minute at a temperature of three-hundred and eighty-five degrees Fahrenheit on the steel roll 62 against the composite roll 64 with a pressure of one ton per linear inch. The calender rolls are rotated at a speed of nine revolutions per minute. The moiré pattern appears on both sides of the textile fabric. However, the moiré pattern produced during the first pass through calender rolls 62 and 64 is placed on the back of the textile fabric. This moiré pattern is removed and replaced after the shifting of the filling yarns with the cylindrical roll member 10 by means of the heat and pressure of the second pass through calender rolls 62 and 64, as shown by the photomicrograph of FIG. 7 at 1.9 magnification.

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

What is claimed is:

1. A process of creating a moiré pattern on textile fabric, having warp yarns and filling yarns, comprising the steps of:

(a) moving a first endless web of said textile fabric over a support member with a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

2. A process of creating a moiré pattern on textile fabric, having warp yarns and filling yarns, comprising the steps of:

(a) moving a first endless web of said textile fabric over a rectangular support member with a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

3. A process of creating a moiré pattern on textile fabric, having warp yarns and filling yarns, comprising the steps of:

(a) moving a first endless web of said textile fabric over a cylindrical support member with a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

4. A process of creating a moiré pattern on textile fabric, having warp yarns and filling yarns, comprising the steps of:

(a) moving a first endless web of said textile fabric over a rectangular support member with a plurality of first portions of a first width, a plurality of second portions of a second width and plurality of tapered interconnecting portions therebetween, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

5. A process of creating a moiré pattern on textile fabric, having warp yarns and filling yarns, comprising the steps of:

(a) moving a first endless web of said textile fabric over a cylindrical support member with a plurality of first portions of a first diameter, a plurality of second portions of a second diameter and plurality of tapered interconnecting portions therebetween, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

6. A process of creating a moiré pattern on textile fabric, having warp yarns and filling yarns, comprising the steps of:

(a) moving a first endless web of said textile fabric over a support member at an angle of between forty-five degrees to two hundred and seventy degrees with a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

7. A process of creating a moiré pattern on textile fabric, having warp yarns and filling yarns, comprising the steps of:

(a) moving a first endless web of said textile fabric over a cylindrical support member with a plurality of first portions of a first diameter, a plurality of second portions of a second diameter and plurality of tapered interconnecting portions therebetween wherein said plurality of first diameters is larger than said plurality of second diameters by at least one thirty-second of an inch, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

8. A process of creating a moiré pattern on textile fabric, having warp yarns and filling yarns, comprising the steps of:

(a) moving a first endless web of said textile fabric over a cylindrical support member with a plurality of first portions of a first diameter of at least one sixteenth of an inch, a plurality of second portions of a second diameter of at least one-thirty second of an inch and plurality of tapered interconnecting portions therebetween, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

9. A process of creating a moiré pattern on textile fabric, having warp yarns and filling yarns, comprising the steps of:

(a) moving a first endless web of said textile fabric over a cylindrical support member having a longitudinal axis with a plurality of first portions of a first diameter each extending along said longitudinal axis for at least one thirty-second of an inch, a plurality of second portions of a second diameter each extending along said longitudinal axis for at least one thirty-second of an inch and plurality of tapered interconnecting portions therebetween each extending along said longitudinal axis for at least one thirty-second of an inch, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

10. A process of creating a moiré pattern on textile fabric, having warp yarns and filling yarns, comprising the steps of:

(a) moving a first endless web of said textile fabric over a rectangular support member with a plurality of first portions of a first width, a plurality of second portions of a second width and plurality of tapered interconnecting portions therebetween wherein said first width is larger than said second width by at least one thirty-second of an inch, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

11. A process of creating a moiré pattern on textile fabric, having warp yarns and filling yarns, comprising the steps of:

(a) moving a first endless web of said textile fabric over a rectangular support member with a plurality of first portions of a first width of at least one sixteenth of an inch, a plurality of second portions of a second width of at least one thirty-second of an inch and plurality of tapered interconnecting portions therebetween, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

12. A process of creating a moiré pattern on textile fabric, having warp yarns and filling yarns, comprising the steps of:

(a) moving a first endless web of said textile fabric over a rectangular support member having a longitudinal axis with a plurality of first portions of a first width each extending along said longitudinal axis for at least one thirty-second of an inch, a plurality of second portions of a second width each extending along said longitudinal axis for at least one thirty-second of an inch and plurality of tapered interconnecting portions therebetween each extending along said longitudinal axis for at least one thirty-second of an inch, thereby forming a plurality of lobes that retard the movement of said filling yarns and a plurality of valleys that advance the movement of said filling yarns;

(b) combining said first endless web of said textile fabric with a second endless web of textile fabric in overlapping relationship; and (c) applying pressure in the range of between 300 to 10,000 pounds per linear inch to said combination of said first endless web of textile fabric and said second endless web of textile fabric to create a moiré pattern on said first endless web of textile fabric.

13. An apparatus for creating a moiré pattern on textile fabric, having warp yarns and filling yarns, comprising of:

(a) a means for moving a first endless web of textile fabric over a support member with a plurality of lobes that retard the movement of said filling yarns and a plurality of valleys that advance the movement of said filling yarns;

(b) a means for combining said first endless web of said textile fabric with a second endless web of textile fabric in overlapping relationship; and (c) a means for applying pressure in the range of between 300 to 10,000 pounds per linear inch to said combination of said first endless web of textile fabric and said second endless web of textile fabric to create a moiré pattern on said first endless web of textile fabric.

14. An apparatus for creating a moiré pattern on textile fabric as defined in claim 13, wherein said support member, having a longitudinal axis, is rectangular.

15. An apparatus for creating a moiré pattern on textile fabric as defined in claim 13, wherein said support member, having a longitudinal axis, is cylindrical.

16. An apparatus for creating a moiré pattern on textile fabric as defined in claim 14, wherein said rectangular support member includes a plurality of first portions of a first width, a plurality of second portions of a second width and plurality of tapered interconnecting portions therebetween.

17. An apparatus for creating a moiré pattern on textile fabric as defined in claim 15, wherein said cylindrical support member includes a plurality of first portions of a first diameter, a plurality of second portions of a second diameter and plurality of tapered interconnecting portions therebetween.

18. An apparatus for creating a moiré pattern on textile fabric as defined in claim 15, wherein said cylindrical support member includes a plurality of first portions of a first diameter, a plurality of second portions of a second diameter and plurality of tapered interconnecting portions therebetween wherein each of said plurality of first diameters is larger than each of said plurality of second diameters by at least one thirty-second of an inch.

19. An apparatus for creating a moiré pattern on textile fabric as defined in claim 15, wherein said cylindrical support member includes a plurality of first portions each of a first diameter of at least one sixteenth of an inch, a plurality of second portions each of a second diameter of at least one-thirty second of an inch and plurality of tapered interconnecting portions therebetween.

20. An apparatus for creating a moiré pattern on textile fabric as defined in claim 15, wherein said cylindrical support member includes a plurality of first portions of a first diameter each extending along said longitudinal axis for at least one thirty-second of an inch, a plurality of second portions of a second diameter each extending along said longitudinal axis for at least one thirty-second of an inch and plurality of tapered interconnecting portions therebetween each extending along said longitudinal axis for at least one thirty-second of an inch.

21. An apparatus for creating a moiré pattern on textile fabric as defined in claim 14, wherein said rectangular support member includes a plurality of first portions of a first width, a plurality of second portions of a second width and plurality of tapered interconnecting portions therebetween wherein each said first width is larger than each said second width by at least one thirty-second of an inch.

22. An apparatus for creating a moiré pattern on textile fabric as defined in claim 14, wherein said rectangular support member includes a plurality of first portions each of a first width of at least one sixteenth of an inch, a plurality of second portions of a second width each of at least one thirty-second of an inch and plurality of tapered interconnecting portions therebetween.

23. An apparatus for creating a moiré pattern on textile fabric as defined in claim 14, wherein said rectangular support member includes a plurality of first portions of a first width each extending along said longitudinal axis for at least one thirty-second of an inch, a plurality of second portions of a second width each extending along said longitudinal axis for at least one thirty-second of an inch and plurality of tapered interconnecting portions therebetween each extending along said longitudinal axis for at least one thirty-second of an inch.

* * * * *